US011236745B2

(12) United States Patent
Kato et al.

(10) Patent No.: US 11,236,745 B2
(45) Date of Patent: Feb. 1, 2022

(54) SCROLL COMPRESSOR HAVING INJECTION PASSAGE INCLUDING FIRST AND SECOND OUTLET PASSAGE SECTIONS

(71) Applicant: Mitsubishi Electric Corporation, Tokyo (JP)

(72) Inventors: Keisuke Kato, Tokyo (JP); Akihito Takai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/960,669

(22) PCT Filed: Jan. 30, 2018

(86) PCT No.: PCT/JP2018/002894
§ 371 (c)(1),
(2) Date: Jul. 8, 2020

(87) PCT Pub. No.: WO2019/150421
PCT Pub. Date: Aug. 8, 2019

(65) Prior Publication Data

US 2020/0332795 A1 Oct. 22, 2020

(51) Int. Cl.
*F04C 2/02* (2006.01)
*F04C 15/06* (2006.01)
(Continued)

(52) U.S. Cl.
CPC ..... *F04C 2/025* (2013.01); *F04C 15/06* (2013.01); *F04C 18/0215* (2013.01);
(Continued)

(58) Field of Classification Search
CPC ..... F04C 2/025; F04C 18/0207–0292; F04C 15/06; F04C 29/12; F04C 29/0007; F01C 1/0207–0292; F01C 21/001; F01C 21/18
See application file for complete search history.

(56) References Cited

U.S. PATENT DOCUMENTS 6,062,834 A 5/2000 Masumoto et al.
6,106,253 A * 8/2000 Sakai ..... F04C 29/0007 418/55.6

FOREIGN PATENT DOCUMENTS

EP 2461122 A1 * 6/2012 ..... F04C 29/0007
EP 2461122 A1 6/2012
(Continued)

OTHER PUBLICATIONS

International Search Report of the International Searching Authority dated Apr. 17, 2018 for the corresponding international application No. PCT/JP2018/002894 (and English translation).
(Continued)

*Primary Examiner* — Laert Dounis
(74) *Attorney, Agent, or Firm* — Posz Law Group, PLC

(57) ABSTRACT

A scroll compressor includes a fixed scroll including a first end plate having an injection passage through which refrigerant is supplied to a refrigerant suction chamber. The injection passage includes an outlet passage section that opens into the refrigerant suction chamber and extends linearly. A refrigerant compression chamber is disposed on an extension of the outlet passage section.

7 Claims, 15 Drawing Sheets

(51) Int. Cl.
*F04C 18/02* (2006.01)
*F04C 29/00* (2006.01)
*F04C 23/00* (2006.01)

(52) U.S. Cl.
CPC ..... *F04C 18/0261* (2013.01); *F04C 23/008* (2013.01); *F04C 29/0007* (2013.01); *F04C 2210/26* (2013.01)

(56) References Cited

FOREIGN PATENT DOCUMENTS

| | | | | | |
|---|---|---|---|---|---|
| JP | 03294686 | A | * | 12/1991 | ..... F04C 29/0007 |
| JP | H03-294686 | A | | 12/1991 | |
| JP | 07269475 | A | * | 10/1995 | ..... F04C 28/16 |
| JP | H10-339283 | A | | 12/1998 | |
| JP | 2011047382 | A | * | 3/2011 | |
| JP | 2012-180838 | A | | 9/2012 | |
| JP | 2012184750 | A | * | 9/2012 | |
| WO | WO-2019234823 | A1 | * | 12/2019 | ..... F04C 29/04 |
| WO | WO-2020215663 | A1 | * | 10/2020 | ..... F04C 18/02 |

OTHER PUBLICATIONS

Chinese Office Action dated Aug. 9, 2021 issued in corresponding Chinese patent application No. 201880087633.7 (and English translation).

* cited by examiner

SCROLL COMPRESSOR HAVING INJECTION PASSAGE INCLUDING FIRST AND SECOND OUTLET PASSAGE SECTIONS

CROSS REFERENCE TO RELATED APPLICATION

This application is a U.S. national stage application of PCT/JP2018/002894 filed on Jan. 30, 2018, the contents of which are incorporated herein by reference.

TECHNICAL FIELD

The present disclosure relates to scroll compressors, and in particular, relates to a scroll compressor including a compression mechanism having an injection passage.

BACKGROUND ART

A related-art scroll compressor includes an electric mechanism including a stator and a rotor, a shaft fitted in the rotor, and a compression mechanism including an orbiting scroll disposed on an end of the shaft and a fixed scroll engaged with the orbiting scroll (refer to, for example, Patent Literature 1). The compression mechanism has a refrigerant compression chamber defined between a spiral element of the fixed scroll and a spiral element of the orbiting scroll and a refrigerant suction chamber disposed upstream of the refrigerant compression chamber in a direction in which refrigerant flows. In the scroll compressor disclosed in Patent Literature 1, the refrigerant suction chamber is disposed outside the refrigerant compression chamber.

The fixed scroll of the scroll compressor disclosed in Patent Literature 1 has an injection port that opens into the refrigerant compression chamber. The refrigerant is supplied to the refrigerant compression chamber through the injection port, resulting in a reduction in temperature of the refrigerant to be discharged from the scroll compressor.

CITATION LIST

Patent Literature

Patent Literature 1: Japanese Unexamined Patent Application Publication No. 10-339283

SUMMARY OF INVENTION

Technical Problem

In the scroll compressor disclosed in Patent Literature 1, liquid refrigerant supplied to the refrigerant compression chamber through the injection port expands in the refrigerant compression chamber. The expansion of the refrigerant supplied to the refrigerant compression chamber through the injection port results in an increase in pressure of the refrigerant in the refrigerant compression chamber. Consequently, the spiral element of the orbiting scroll is subjected to a force increased by the increase in pressure of the refrigerant in the refrigerant compression chamber, so that the force applied to the spiral element of the orbiting scroll interferes with motion of the orbiting scroll. Therefore, the expansion of the refrigerant supplied to the refrigerant compression chamber through the injection port hinders the motion of the orbiting scroll by a force applied to the spiral element of the orbiting scroll, leading to a reduction in compressor efficiency of the scroll compressor.

The present disclosure has been made to overcome the above-described problem and aims at providing a scroll compressor in which an increase in pressure in a refrigerant compression chamber is reduced to improve compressor efficiency.

Solution to Problem

A scroll compressor according to an embodiment of the present disclosure includes a hermetic container and a compression mechanism disposed in the hermetic container and having a refrigerant compression chamber and a refrigerant suction chamber disposed upstream of the refrigerant compression chamber in a direction in which refrigerant flows. The compression mechanism includes: a fixed scroll including a first end plate having a discharge passage, into which the refrigerant flows out of the refrigerant compression chamber; and a first spiral element disposed on the first end plate; and an orbiting scroll including a second end plate disposed at a distance from the first end plate and a second spiral element disposed on the second end plate. The second spiral element defines the refrigerant compression chamber with the first spiral element. The first end plate has an injection passage through which the refrigerant is supplied to the refrigerant suction chamber. The injection passage includes an outlet passage section that opens into the refrigerant suction chamber and extends linearly. The refrigerant compression camber is disposed on an extension of the outlet passage section.

Advantageous Effects of Invention

According to the embodiment of the present disclosure, the injection passage, through which the refrigerant is supplied to the refrigerant suction chamber, reduces an increase in pressure in the refrigerant compression chamber, leading to improved compressor efficiency.

DESCRIPTION OF EMBODIMENTS

Embodiment 1

Embodiment 1 will be described below with reference to the drawings. Note that the relationship between the sizes of components in the following figures may differ from that of actual ones. Furthermore, note that the forms of the components described herein are intended to be illustrative only and are not intended to be limited to those described herein.

<Configuration in Embodiment 1>

Figure 1:
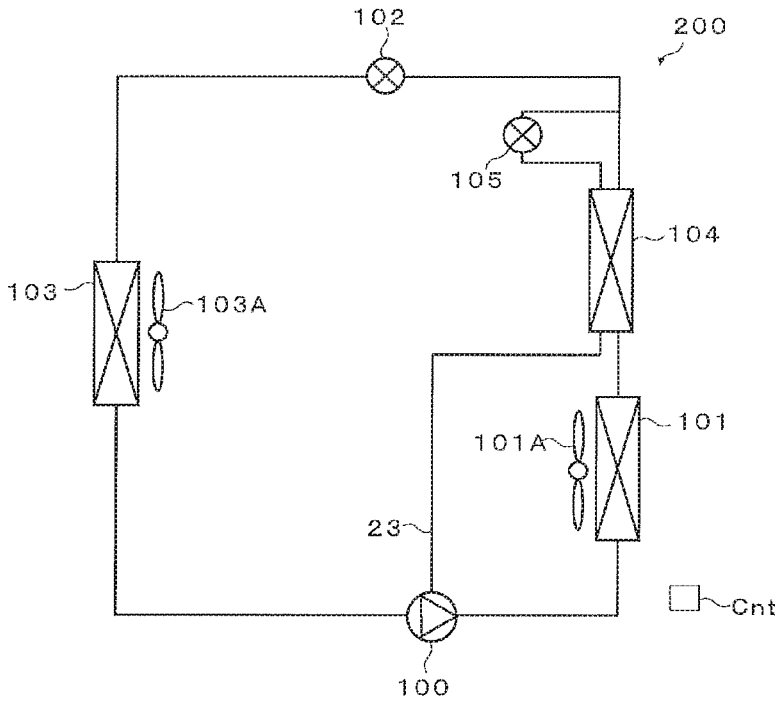
FIG. 1 is a schematic diagram of an exemplary configuration of a refrigeration cycle apparatus 200 including a scroll compressor 100 according to Embodiment 1.

FIG. 1 is a schematic diagram of an exemplary configuration of a refrigeration cycle apparatus 200 including a scroll compressor 100 according to Embodiment 1. The configuration of the refrigeration cycle apparatus 200 will now be described with reference to FIG. 1. The refrigeration cycle apparatus 200 includes the scroll compressor 100 to compress refrigerant, a condenser 101 to liquefy the refrigerant, an expansion device 102 to reduce the pressure of the refrigerant, and an evaporator 103 to gasify the refrigerant. The refrigeration cycle apparatus 200 further includes a fan 101A to supply air to the condenser 101 and a fan 103A to supply air to the evaporator 103. In addition, the refrigeration cycle apparatus 200 includes a heat exchanger 104 disposed downstream of the condenser 101 and upstream of the expansion device 102 in a refrigerant flow direction and an expansion device 105 to reduce the pressure of the refrigerant to be supplied to the heat exchanger 104. Additionally, the refrigeration cycle apparatus 200 includes a controller Cnt to control a rotation speed of the scroll compressor 100, an opening degree of the expansion device 102, an opening degree of the expansion device 105, a rotation speed of the fan 101A, and a rotation speed of the fan 103A. The controller Cnt can perform injection control for supplying the refrigerant to the scroll compressor 100 by opening the expansion device 105.

Figure 2:
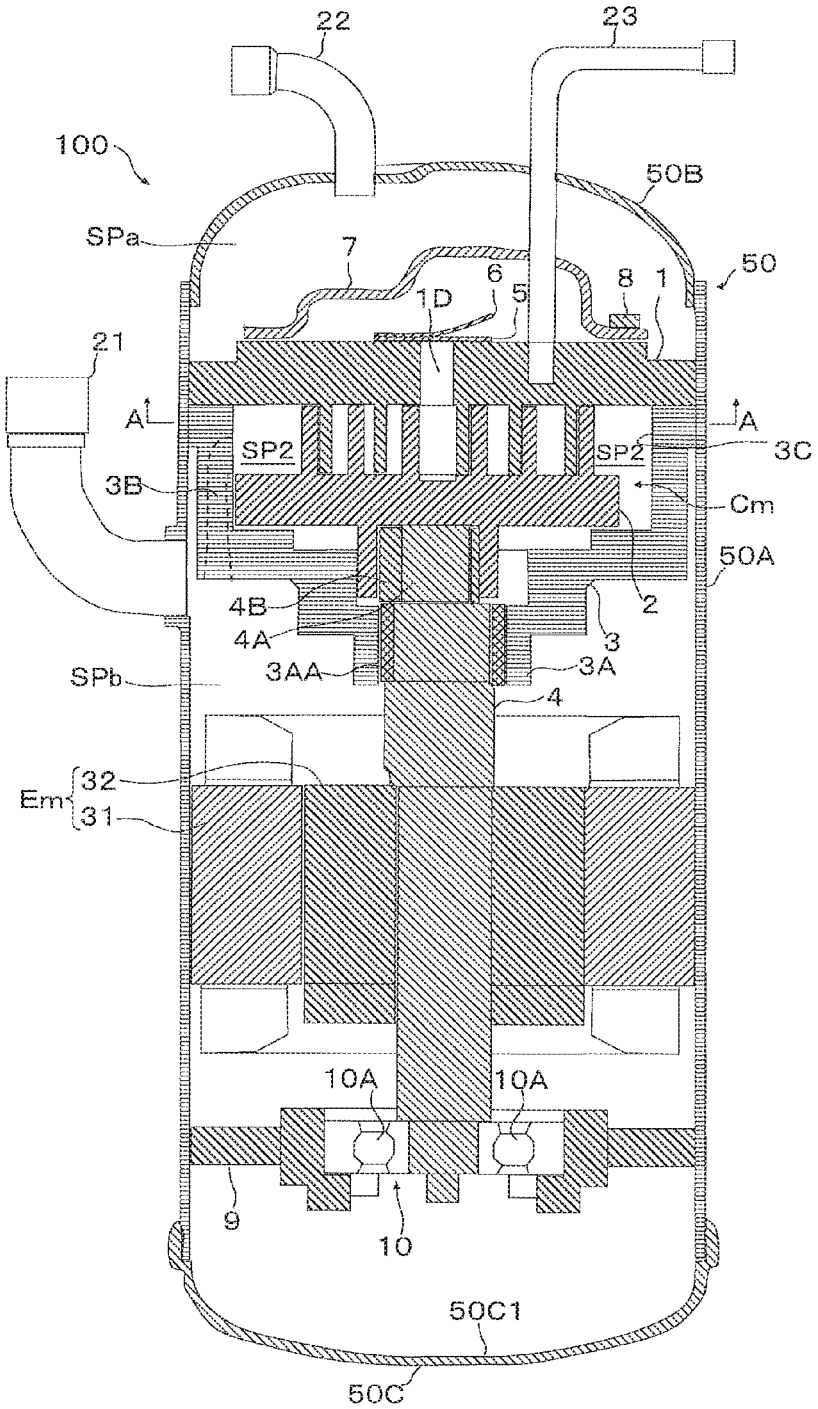
FIG. 2 is a sectional view of the scroll compressor 100 according to Embodiment 1.
Figure 3:
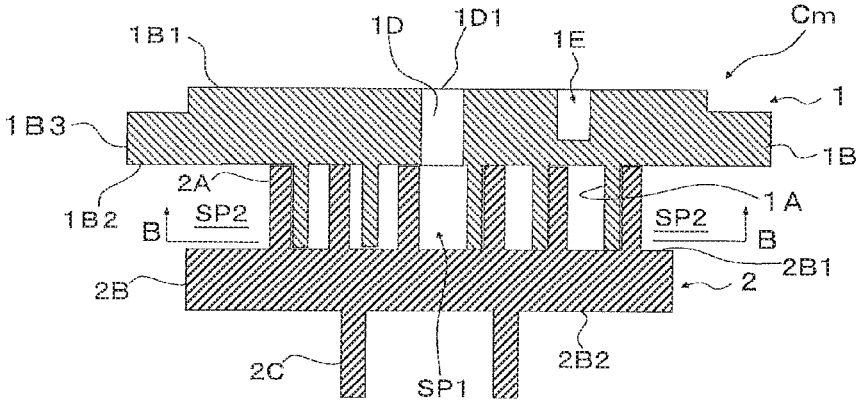
FIG. 3 is an enlarged view of a compression mechanism Cm in FIG. 2.

FIG. 2 is a sectional view of the scroll compressor 100 according to Embodiment 1. FIG. 3 is an enlarged view of a compression mechanism Cm in FIG. 2. The configuration of the scroll compressor 100 will now be described with reference to FIGS. 2 and 3. The scroll compressor 100 compresses the refrigerant to increase the pressure of the refrigerant and the temperature of the refrigerant. The scroll compressor 100 includes a hermetic container 50 forming a shell of the scroll compressor 100 and a drive mechanism Em including a stator E31 fixed to the hermetic container 50 and a rotor E32 that is rotatable relative to the stator. The scroll compressor 100 further includes the compression mechanism Cm including a fixed scroll 1 and an orbiting scroll 2, a frame 3 containing the orbiting scroll 2, and a shaft 4 fixed to the rotor E32. The shaft 4 includes an eccentric portion 4A disposed at an upper end of the shaft 4. The axis of the eccentric portion 4A is offset from the axis of a part of the shaft 4 that is fitted in the rotor E32. The scroll compressor 100 further includes a sleeve 3AA disposed between the frame 3 and the shaft 4 and a cylindrical slider 4B disposed on the eccentric portion 4A of the shaft 4. In addition, the scroll compressor 100 includes a suction pipe 21 through which the refrigerant is introduced into the hermetic container 50, a discharge pipe 22 through which the refrigerant compressed by the compression mechanism Cm is discharged out of the hermetic container 50, and an injection pipe 23 that connects to the heat exchanger 104 described with reference to FIG. 1 and through which the refrigerant subjected to heat exchange in the heat exchanger 104 is supplied to the compression mechanism Cm.

The scroll compressor 100 includes a discharge valve 5 disposed on the fixed scroll 1, a valve guard 6 disposed on the discharge valve 5, a sound-absorbing muffler 7 disposed on the fixed scroll 1, and a fastener 8 fastening the sound-absorbing muffler 7 onto the fixed scroll 1. The scroll compressor 100 further includes a sub-frame 9 fixed to the hermetic container 50 and a sub-bearing 10 disposed in the sub-frame 9 and supporting a lower end of the shaft 4.

The hermetic container 50 includes a body 50A to which the frame 3, the stator E31, and the sub-frame 9 are fixed, a container upper portion 50B press-fitted in the body 50A, and a container lower portion 50C press-fitted on the body 50A. The suction pipe 21 is fitted in the body 50A. The discharge pipe 22 and the injection pipe 23 are fitted in the container upper portion 50B. The container lower portion 50C serves as a bottom sump 50C1 in which refrigerating machine oil is stored. The fixed scroll 1 includes a first spiral element 1A and a first end plate 1B disposed perpendicular to the first spiral element 1A. The first end plate 1B has a discharge passage 1D, through which the refrigerant compressed by the compression mechanism Cm flows, and a discharge port 1D1 located at an upper end of the discharge passage 1D. The discharge valve 5 is disposed at the discharge port 1D1. The orbiting scroll 2 includes a second spiral element 2A engaged with the first spiral element 1A, a second end plate 2B disposed perpendicular to the second spiral element 2A, and a boss 2C in which the upper end of the shaft 4 and the slider 4B are fitted. The second end plate 2B is disposed at a distance from the first end plate 1B.

As illustrated in FIG. 3, the compression mechanism Cm has a refrigerant compression chamber SP1, which connects to the discharge passage 1D, and a refrigerant suction chamber SP2 disposed upstream of the refrigerant compression chamber SP1 in the refrigerant flow direction. The refrigerant compression chamber SP1 is defined between the first end plate 1B and the second end plate 2B and between the first spiral element 1A and the second spiral element 2A. The refrigerant suction chamber SP2 is defined between the first end plate 1B and the second end plate 2B. The refrigerant compression chamber SP1 is disposed inside the refrigerant suction chamber SP2. The refrigerant suction chamber SP2 is disposed inside the frame 3 and outside the refrigerant compression chamber SP1. As illustrated in FIG. 2, a space inside the hermetic container 50 includes an upper space SPa that is located above the fixed scroll 1 and through which the refrigerant compressed in the refrigerant compression chamber SP1 flows and a lower space SPb that is located below the frame 3. The frame 3 contains the orbiting scroll 2. The frame 3 includes a main bearing 3A in which the shaft 4 is fitted, and has a suction passage 3B communicating between the lower space SPb and the refrigerant suction chamber SP2 and an inner circumferential face 3C surrounding the first spiral element 1A and the second spiral element 2A.

Figure 4:
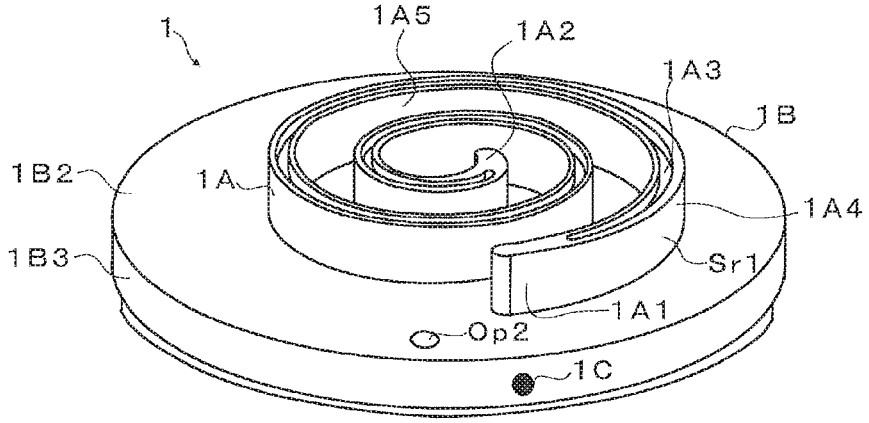
FIG. 4 is a perspective view of a fixed scroll 1.
Figure 5:
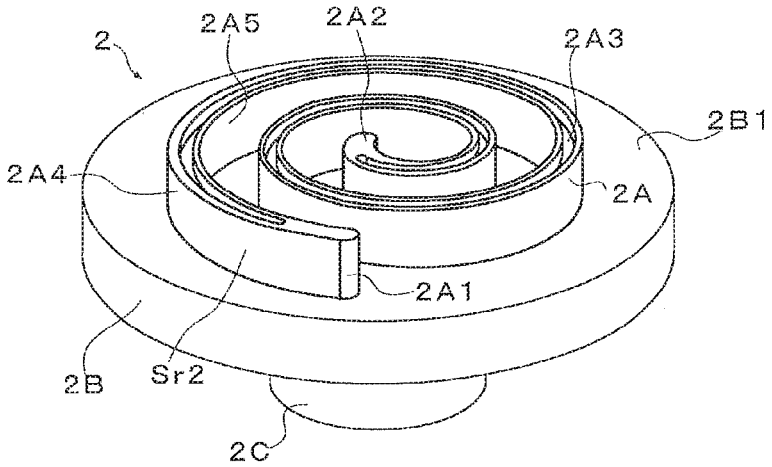
FIG. 5 is a perspective view of an orbiting scroll 2.
Figure 6:
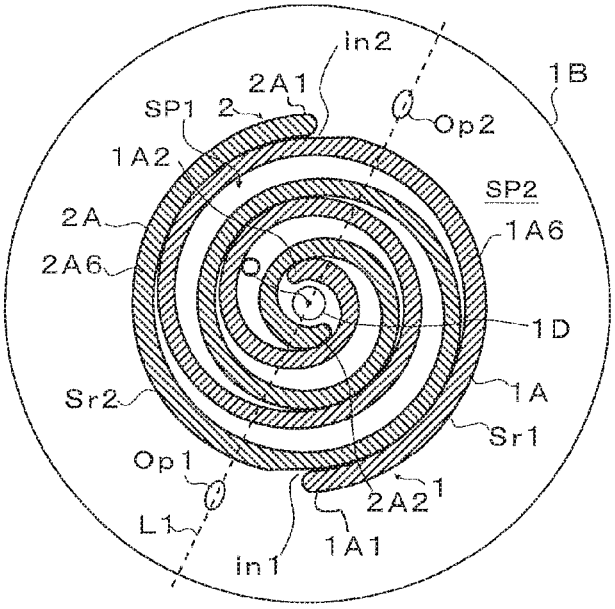
FIG. 6 is a cross-sectional plan view taken along line B-B in FIG. 3.

FIG. 4 is a perspective view of the fixed scroll 1. FIG. 4 illustrates the fixed scroll 1 in FIG. 3 when it is inverted. FIG. 5 is a perspective view of the orbiting scroll 2. FIG. 6 is a cross-sectional plan view taken along line B-B in FIG. 3. The configuration of the fixed scroll 1 and that of the orbiting scroll 2 will now be described with reference to FIGS. 4 to 6 and FIGS. 2 and 3 described above. As illustrated in FIGS. 3 and 4, the first end plate 1B of the fixed scroll 1 has an upper face 1B1 with the discharge valve 5 described with reference to FIG. 2, a lower face 1B2 being connected to the first spiral element 1A, and a circumferential face 1B3 in a circular form. As illustrated in FIGS. 3 and 5, the second end plate 2B of the orbiting scroll 2 has an upper face 2B1 facing the lower face 1B2 of the first end plate 1B and being connected to the second spiral element 2A and a lower face 2B2 being connected to the boss 2C. The lower face 1B2 of the first end plate 1B of the fixed scroll 1 and the upper face 2B1 of the second end plate 2B of the orbiting scroll 2 face the refrigerant suction chamber SP2.

As illustrated in FIG. 4, the first spiral element 1A of the fixed scroll 1 has a first outer end 1A1 defining one inlet, or a first inlet in1, of the refrigerant compression chamber SP1, a first inner end 1A2 disposed at an edge of the discharge passage 1D described with reference to FIG. 3, and a spiral-shaped first groove 1A3 in which a seal (not illustrated) is fitted. FIG. 6 illustrates a state in which the first inlet in1 is closed. The first spiral element 1A of the fixed scroll 1 has a spiral face 1A4 perpendicular to the first end plate 1B and a spiral face 1A5 parallel to the spiral face 1A4 and perpendicular to the first end plate 1B. The spiral face 1A4 includes a first wall surface Sr1 that does not contact the second spiral element 2A when the first spiral element 1A is engaged with the second spiral element 2A. The first wall surface Sr1 faces the inner circumferential face 3C of the frame 3 described with reference to FIG. 2. The first spiral element 1A includes a first wall portion 1A6, which is a part of the first spiral element 1A that corresponds to the first wall surface Sr1. Referring to FIG. 6, the first wall portion 1A6 separates the refrigerant suction chamber SP2 and the refrigerant compression chamber SP1.

As illustrated in FIG. 5, the second spiral element 2A of the orbiting scroll 2 has a second outer end 2A1 defining the other inlet, or a second inlet in2, of the refrigerant compression chamber SP1, a second inner end 2A2 disposed at the edge of the discharge passage 1D described with reference to FIG. 3, and a spiral-shaped second groove 2A3 in which a seal (not illustrated) is fitted. In the state illustrated in FIG. 6, the second inlet in2 is closed. The second spiral element 2A of the orbiting scroll 2 has a spiral face 2A4 perpendicular to the second end plate 2B and a spiral face 2A5 parallel to the spiral face 2A4 and perpendicular to the second end plate 2B. The spiral face 2A4 includes a second wall surface Sr2 that does not contact the first spiral element 1A when the first spiral element 1A is engaged with the second spiral element 2A. Like the first wall surface Sr1, the second wall surface Sr2 faces the inner circumferential face 3C of the frame 3 described with reference to FIG. 2. The second spiral element 2A includes a second wall portion 2A6, which is a part of the second spiral element 2A that corresponds to the second wall surface Sr2. Referring to FIG. 6, the second wall portion 2A6 separates the refrigerant suction chamber SP2 and the refrigerant compression chamber SP1.

Figure 7:
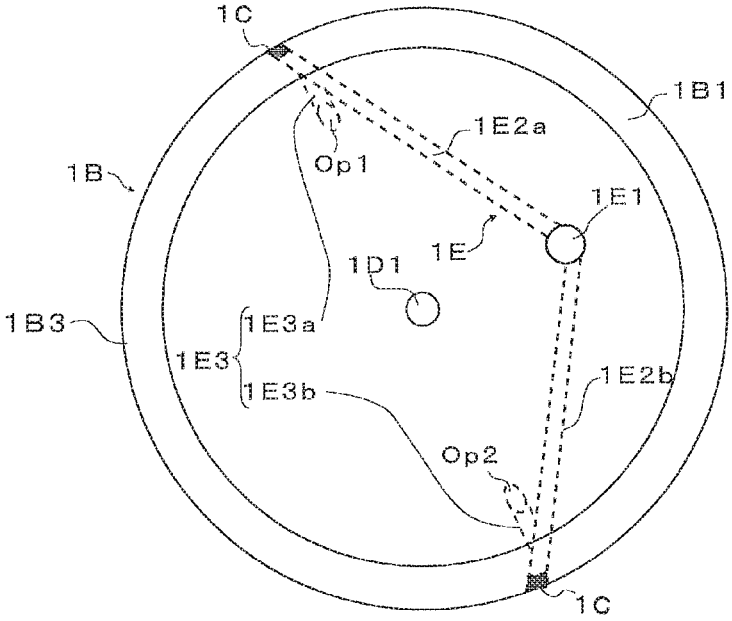
FIG. 7 is a plan view of an upper face 1B1 of a first end plate 1B of the fixed scroll 1.
Figure 8:
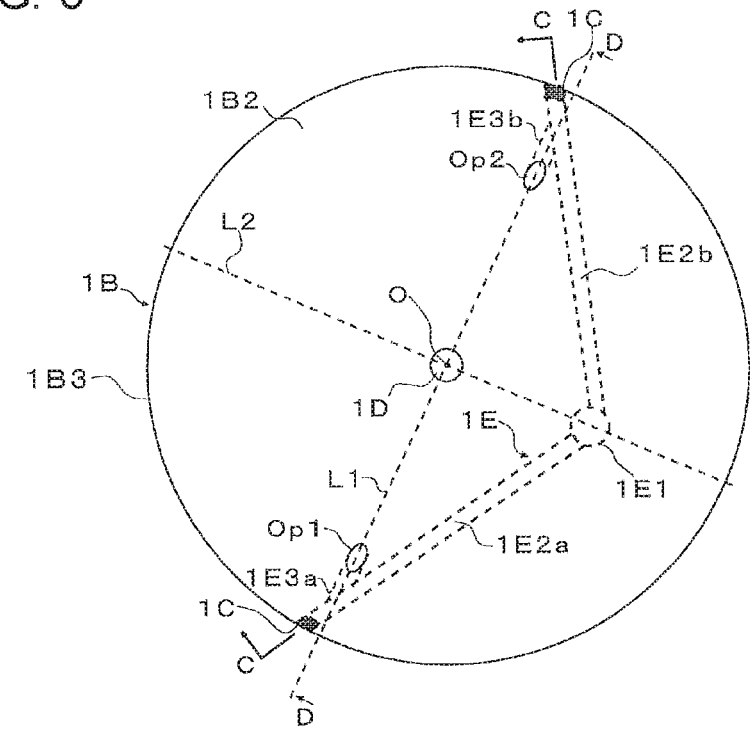
FIG. 8 is a plan view of a lower face 1B2 of the first end plate 1B of the fixed scroll 1.
Figure 9:
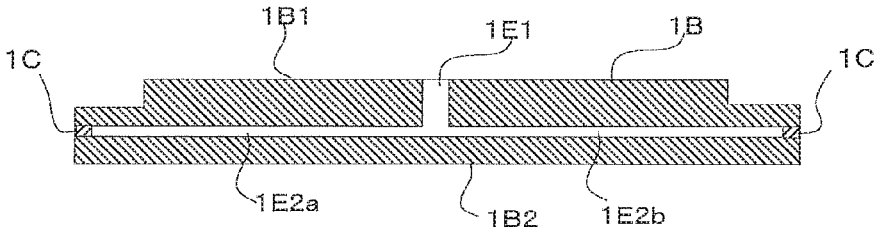
FIG. 9 is a sectional view taken along line C-C in FIG. 8.
Figure 10:
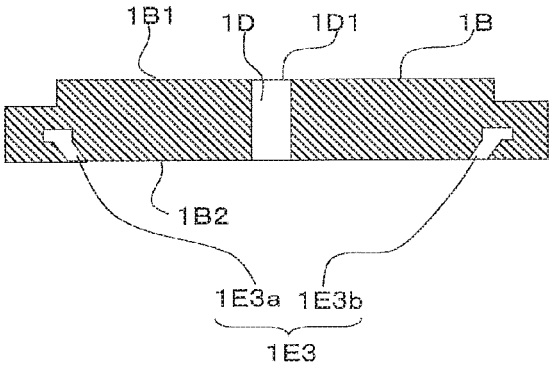
FIG. 10 is a sectional view taken along line D-D in FIG. 8.
Figure 11:
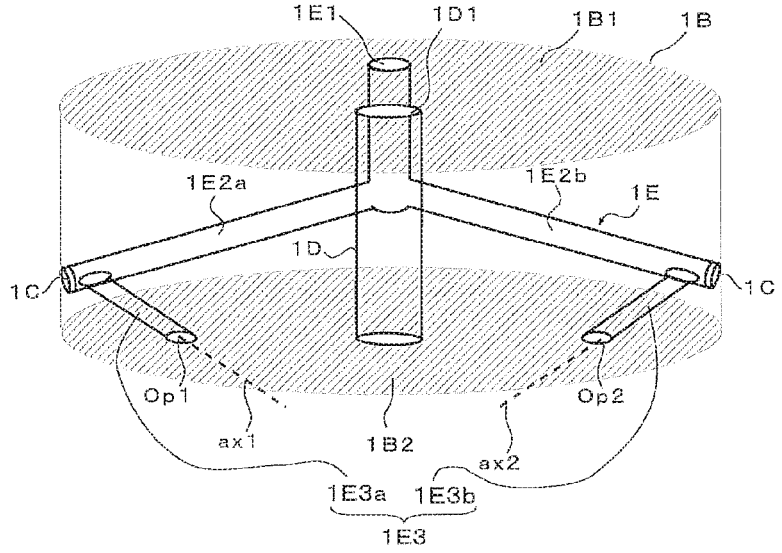
FIG. 11 is a perspective view illustrating an injection passage 1E and a discharge passage 1D.
Figure 12:
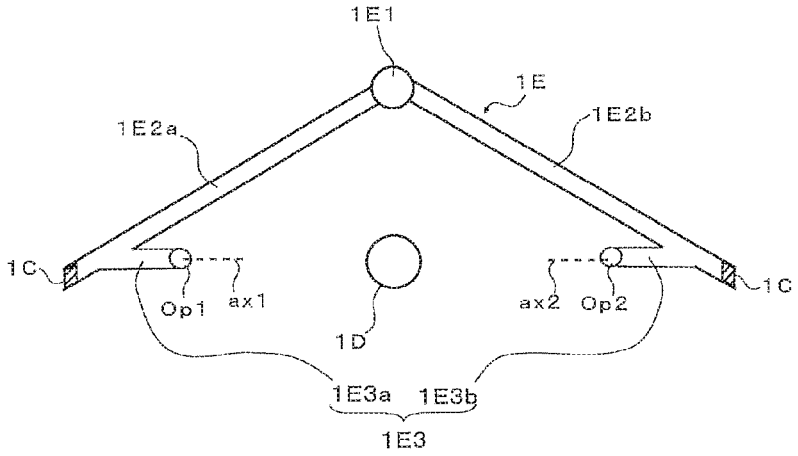
FIG. 12 is a plan view illustrating the injection passage 1E and the discharge passage 1D as viewed from the upper face 1B1 side of the first end plate 1B of the fixed scroll 1.

FIG. 7 is a plan view of the upper face 1B1 of the first end plate 1B of the fixed scroll 1. FIG. 8 is a plan view of the lower face 1B2 of the first end plate 1B of the fixed scroll 1. FIG. 9 is a sectional view taken along line C-C in FIG. 8. FIG. 10 is a sectional view taken along line D-D in FIG. 8. FIG. 11 is a perspective view illustrating the discharge passage 1D and an injection passage 1E. FIG. 12 is a plan view of the discharge passage 1D and the injection passage 1E as viewed from the upper face 1B1 side of the first end plate 1B of the fixed scroll 1. The configuration of the injection passage 1E will now be described with reference to FIGS. 7 to 12 and FIG. 2 described above. The fixed scroll 1 has the injection passage 1E being connected to the injection pipe 23 described with reference to FIG. 2. The fixed scroll 1 includes leak preventing parts 1C that block the injection passage 1E. The leak preventing parts 1C are arranged adjacent to the circumferential face 1B3 of the fixed scroll 1.

The injection passage 1E includes an inlet passage section 1E1 extending from the upper face 1B1 toward the lower face 1B2, a first branch passage section 1E2*a* that is one passage section branching off from the inlet passage section 1E1, and a second branch passage section 1E2*b* that is another passage section branching off from the inlet passage section 1E1. The injection passage 1E further includes outlet passage sections 1E3 through which the refrigerant is supplied from the injection passage 1E to the refrigerant suction chamber SP2, The outlet passage sections 1E3 include a first outlet passage section 1E3*a* being connected to the first branch passage section 1E2*a* and a second outlet passage section 1E3*b* being connected to the second branch passage section 1E2*b*. The first branch passage section 1E2*a* and the second branch passage section 1E2*b* connect to a lower end of the inlet passage section 1E1. The first branch passage section 1E2*a* and the second branch passage section 1E2*b* extend from the lower end of the inlet passage section 1E1 to the circumferential face 1B3.

The first branch passage section 1E2*a* is perpendicular to the inlet passage section 1E1, and the second branch passage section 1E2*b* is perpendicular to the inlet passage section 1E1. As illustrated in FIG. 10, a direction in which the first outlet passage section 1E3*a* extends forms an acute angle with the lower face 1B2. Similarly, a direction in which the second outlet passage section 1E3*b* extends forms an acute angle with the lower face 1B2.

The lower face 1B2 has an opening port Op1 that connects to the first outlet passage section 1E3*a* and opens into the refrigerant suction chamber SP2 and an opening port Opt2 that connects to the second outlet passage section 1E3*b* and opens into the refrigerant suction chamber SP2.

The first branch passage section 1E2*a* and the second branch passage section 1E2*b* are of equal length. The first outlet passage section 1E3*a* and the second outlet passage section 1E3*b* are also of equal length. Therefore, the sum of the lengths of the inlet passage section 1E1, the first branch passage section 1E2*a*, and the first outlet passage section 1E3*a* is equal to the sum of the lengths of the inlet passage section 1E1, the second branch passage section 1E2*b*, and the second outlet passage section 1E3*b*.

Figure 13:
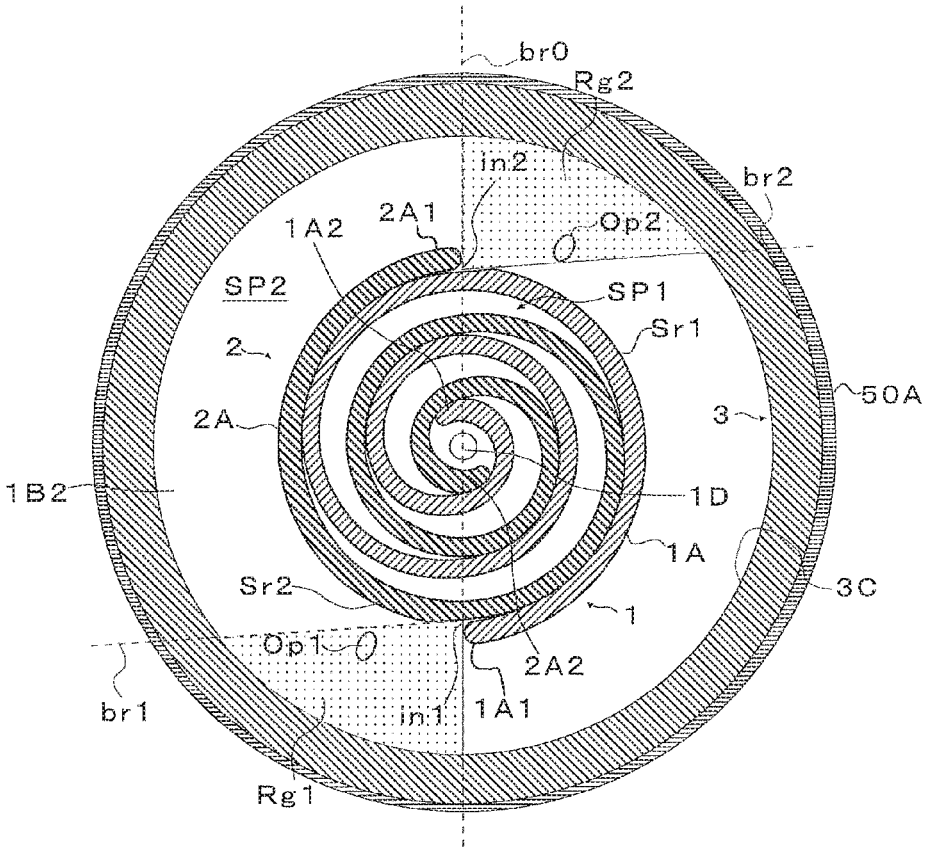
FIG. 13 is a cross-sectional plan view taken along line A-A in FIG. 2.

FIG. 13 is a cross-sectional plan view taken along line A-A in FIG. 2. The positions of the opening port Op1 and the opening port Op2 will now be described with reference to FIG. 13. An imaginary line br0 in FIG. 13 passes through the second outer end 2A1 of the second spiral element 2A, the discharge passage 1D, and the first outer end 1A1 of the first spiral element 1A. An imaginary line br1 in FIG. 13 is a tangent to the second wall surface Sr2 at the position of the first inlet in1 of the refrigerant compression chamber SP1. An imaginary line br2 in FIG. 13 is a tangent to the first wall surface Sr1 at the position of the second inlet in2 of the refrigerant compression chamber SP1.

A region Rg1 in FIG. 13 is a sector-shaped region defined by the imaginary line br0, the imaginary line br1, and the inner circumferential face 3C of the frame 3. A region Rg2 in FIG. 13 is a sector-shaped region defined by the imaginary line br0, the imaginary line br2, and the inner circumferential face 3C of the frame 3. The opening port Op1 is disposed in the region Rg1, and the opening port Op2 is disposed in the region Rg2.

Figure 14:
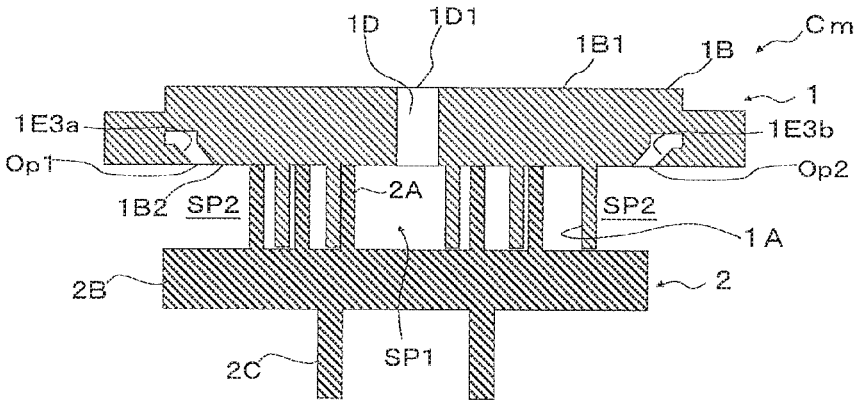
FIG. 14 is a sectional view of the compression mechanism Cm taken along an imaginary line L1 in FIG. 6.
Figure 15:
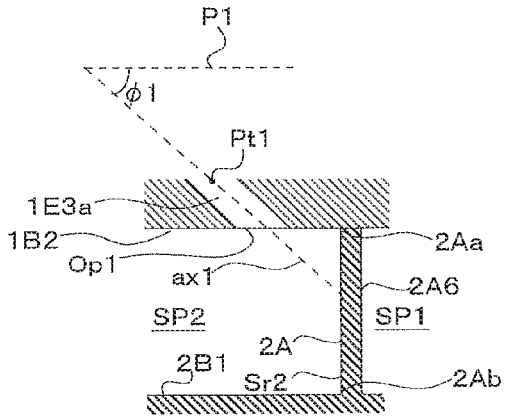
FIG. 15 is a diagram explaining a first outlet passage section 1E3*a* in FIG. 14.

FIG. 14 is a sectional view of the compression mechanism Cm taken along an imaginary line L1 in FIG. 6. FIG. 15 is a diagram explaining the first outlet passage section 1E3*a* in FIG. 14. An imaginary line ax1 in FIG. 15 coincides with the axis of the first outlet passage section 1E3*a* and is parallel to a direction in which the first outlet passage section 1E3*a* extends. An imaginary line P1 in FIG. 15 is parallel to the lower face 1B2. An angle $\phi 1$ in FIG. 15 is formed by the imaginary line ax1 and the imaginary line P1. Referring to FIG. 15, the second wall portion 2A6 and the refrigerant compression chamber SP1 are arranged on an extension of the imaginary line ax1. In other words, the second wall portion 2A6 and the refrigerant compression chamber SP1 are arranged on an extension of the first outlet passage section 1E3*a*.

Figure 16:
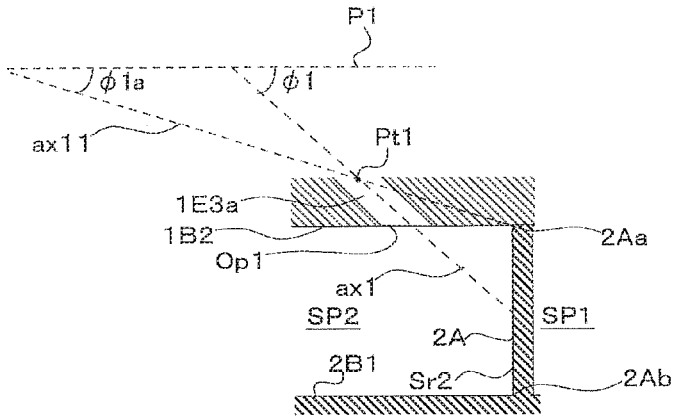
FIG. 16 is a diagram explaining a state in which a second spiral element 2A is located farthest from an opening port Op1 of the first outlet passage section 1E3*a*.
Figure 17:
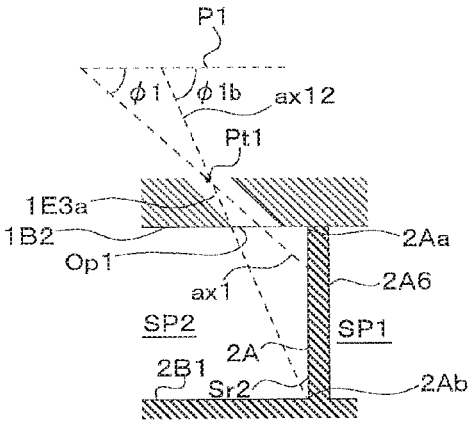
FIG. 17 is a diagram explaining a state in which the second spiral element 2A is located closest to the opening port Op1 of the first outlet passage section 1E3*a*.

FIG. 16 is a diagram explaining a state in which the second spiral element 2A is located farthest from the opening port Op1 of the first outlet passage section 1E3*a*. FIG. 17 is a diagram explaining a state in which the second spiral element 2A is located closest to the opening port Op1 of the first outlet passage section 1E3*a*. Since the second spiral element 2A orbits, the second wall portion 2A6 moves. In Embodiment 1, even when the second wall portion 2A6 moves, the second wall portion 2A6 and the refrigerant compression chamber SP1 are arranged on the extension of the first outlet passage section 1E3*a*. This arrangement will now be described. An imaginary line ax11 in FIG. 16 passes through a point Pt1 on the imaginary line ax1 at an upper end of the first outlet passage section 1E3*a* and an upper end 2A*a* of the second spiral element 2A located farthest from the opening port Op1. An angle $\phi 1a$ in FIG. 16 is formed by the imaginary line ax11 and the imaginary line P1. An imaginary line ax12 in FIG. 17 passes through the point Pt1 and a lower end 2A*b* of the second spiral element 2A located closest to the opening port Op1. An angle $\phi 1b$ in FIG. 17 is formed by the imaginary line ax12 and the imaginary line P1. The angle $\phi 1$ described with reference to FIG. 15 is larger than or equal to the angle $\phi 1a$ in FIG. 16 and is smaller than or equal to the angle $\phi 1b$ in FIG. 17. This ensures that the second wall portion 2A6 and the refrigerant compression chamber SP1 are arranged on the extension of the first outlet passage section 1E3*a* even when the second spiral element 2A orbits.

As illustrated in FIG. 17, even when the second spiral element 2A is located closest to the opening port Op1 of the first outlet passage section 1E3*a*, the first outlet passage section 1E3*a* is not closed by the second spiral element 2A. Specifically, when the second spiral element 2A is located closest to the opening port Op1 of the first outlet passage section 1E3*a*, the whole of the opening port Op1 of the first outlet passage section 1E3*a* is located outside the second spiral element 2A. In other words, the opening port Op1 of the first outlet passage section 1E3*a* is disposed outside a region where the second spiral element 2A moves relative to the lower face 1B2 while orbiting.

Figure 18:
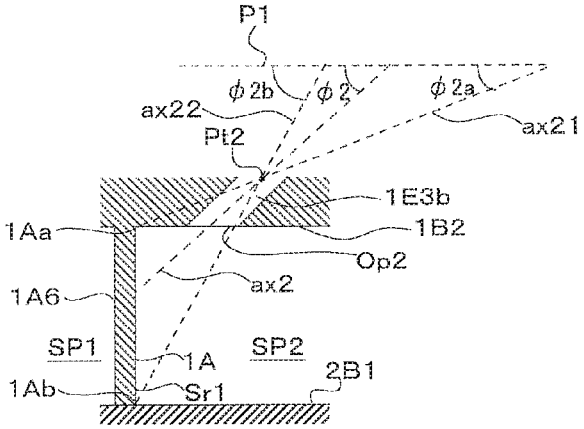
FIG. 18 is a diagram explaining a second outlet passage section 1E3*b* in FIG. 14.

FIG. 18 is a diagram explaining the second outlet passage section 1E3*b* in FIG. 14. The first wall portion 1A6 is disposed on an extension of the second outlet passage section 1E3*b*. An imaginary line ax2 in FIG. 18 coincides with the axis of the second outlet passage section 1E3*b* and is parallel to a direction in which the second outlet passage section 1E3*b* extends. An angle $\phi 2$ in FIG. 18 is formed by the imaginary line ax2 and the imaginary line P1. As illustrated in FIG. 18, the first wall portion 1A6 is disposed on an extension of the imaginary line ax2. In other words, the first wall portion 1A6 is disposed on the extension of the second outlet passage section 1E3*b*.

An imaginary line ax21 in FIG. 18 passes through a point Pt2 on the imaginary line ax2 at an upper end of the second outlet passage section 1E3*b* and an upper end 1A*a* of the first spiral element 1A. An angle $\phi 2a$ in FIG. 18 is formed by the imaginary line ax21 and the imaginary line P1. An imaginary line ax22 in FIG. 18 passes through the point Pt2 and a lower end 1A*b* of the first spiral element 1A. An angle $\phi 2b$ in FIG. 18 is formed by the imaginary line ax22 and the imaginary line P1. The angle $\phi 2$ is larger than or equal to the angle $\phi 2a$ and is smaller than or equal to the angle $\phi 2b$.

<Operation in Embodiment 1>

Figure 19:
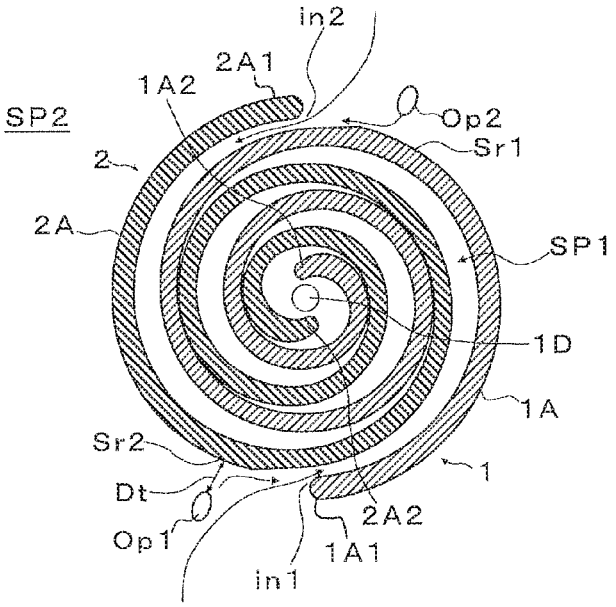
FIG. 19 schematically illustrates a state in which the second spiral element 2A is apart from a first outer end 1A1 of a first spiral element 1A and the first spiral element 1A is apart from a second outer end 2A1 of the second spiral element 2A.

FIG. 19 schematically illustrates a state in which the first outer end 1A1 of the first spiral element 1A is apart from the second spiral element 2A and the second outer end 2A1 of the second spiral element 2A is apart from the first spiral element 1A. In the state illustrated in FIG. 19, since the first outer end 1A1 of the first spiral element 1A is apart from the second spiral element 2A, the first inlet in1 is open. Since the second outer end 2A1 of the second spiral element 2A is apart from the first spiral element 1A, the second inlet in2 is open. The refrigerant for injection is supplied to the refrigerant suction chamber SP2 through the opening port Op1 and the opening port Op2. In addition, the refrigerant that has flowed from the lower space SPb through the suction passage 3B described with reference to FIG. 2 is supplied to the refrigerant suction chamber SP2. In the state of FIG. 19, the refrigerant supplied to the refrigerant suction chamber SP2 through the opening port Op1 collides with the second wall surface Sr2 on the second wall portion 2A6, then flows along the second wall surface Sr2, and enters the first inlet in1. Additionally, the refrigerant supplied to the refrigerant suction chamber SP2 through the opening port Op2 collides with the first wall surface Sr1 on the first wall portion 1A6, then flows along the first wall surface Sr1, and enters the second inlet in2. Furthermore, the refrigerant that has flowed from the lower space SPb through the suction passage 3B also flows into the first inlet in1 and the second inlet in2.

Figure 20:
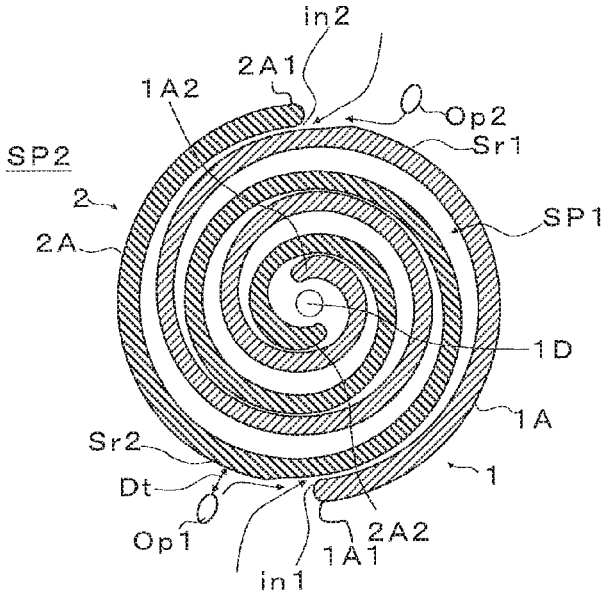
FIG. 20 schematically illustrates movement of the second spiral element 2A from a position in FIG. 19.

FIG. 20 schematically illustrates movement of the second spiral element 2A from a position illustrated in FIG. 19. Although the first inlet in1 and the second inlet in2 are open in a state illustrated in FIG. 20, the first inlet in1 and the second inlet in2 are narrower than those illustrated in FIG. 19. In the state of FIG. 20, the refrigerant supplied to the refrigerant suction chamber SP2 through the opening port Op1 collides with the second wall surface Sr2 on the second wall portion 2A6, then flows along the second wall surface Sr2, and enters the first inlet in1. Additionally, the refrigerant supplied to the refrigerant suction chamber SP2 through the opening port Op2 collides with the first wall surface Sr1 on the first wall portion 1A6, then flows along the first wall surface Sr1, and enters the second inlet in2. Furthermore, the refrigerant that has flowed from the lower space SPb through the suction passage 3B also flows into the first inlet in1 and the second inlet in2. A distance Dt between the second spiral element 2A and the opening port Op1 in FIG. 20 is smaller than that in FIG. 19.

Figure 21:
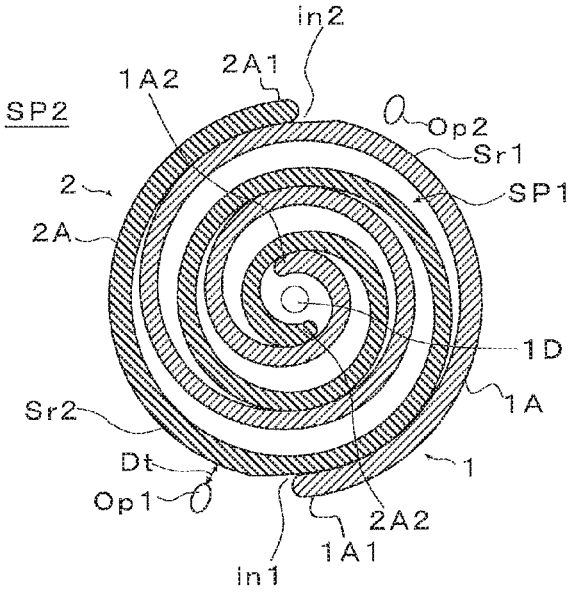
FIG. 21 schematically illustrates a state in which the second spiral element 2A is in contact with the first outer end 1A1 of the first spiral element 1A and the first spiral element 1A is in contact with the second outer end 2A1 of the second spiral element 2A.

FIG. 21 schematically illustrates a state in which the first outer end 1A1 of the first spiral element 1A is in contact with the second spiral element 2A and the second outer end 2A1 of the second spiral element 2A is in contact with the first spiral element 1A. In the state illustrated in FIG. 21, the first inlet in1 and the second inlet in2 are closed. Consequently, the refrigerant in the refrigerant suction chamber SP2 does not flow into the refrigerant compression chamber SP1. In the state of FIG. 20, the refrigerant in the refrigerant compression chamber SP1 contains not only the refrigerant that has flowed into the refrigerant suction chamber SP2 from the suction passage 3B but also the refrigerant that has flowed into the refrigerant suction chamber SP2 through the opening port Op1 and the opening port Op2. The refrigerant in the refrigerant compression chamber SP1 approaches the discharge passage 1D while moving circularly. The distance Dt between the second spiral element 2A and the opening port Op1 in FIG. 21 is smaller than that in FIG. 20. In the state of FIG. 21, the second spiral element 2A is located closest to the opening port Op1 of the first outlet passage section 1E3*a*. In other words, the state of FIG. 21 corresponds to the state of FIG. 17 described above.

Figure 22:
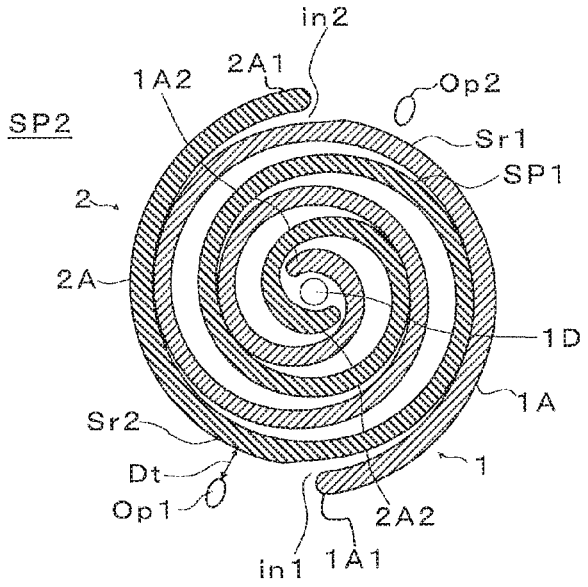
FIG. 22 schematically illustrates movement of the second spiral element 2A from a position in FIG. 21.

FIG. 22 schematically illustrates movement of the second spiral element 2A from a position illustrated in FIG. 21. In a state illustrated in FIG. 22, the first inlet in1 and the second inlet in2 are closed. In the state of FIG. 22, a pressure at the innermost part of the refrigerant compression chamber SP1 is high enough to lift the discharge valve 11 described with reference to FIG. 2. Consequently, the discharge port 1D1 is opened. Thus, the refrigerant at the innermost part of the refrigerant compression chamber SP1 passes through the discharge passage 1D described with reference to FIG. 2 and flows into a space inside the sound-absorbing muffler 7. The distance Dt between the second spiral element 2A and the opening port Op1 in FIG. 22 is larger than that in FIG. 21.

<Advantageous Effects of Embodiment 1>

The scroll compressor 100 according to Embodiment 1 has the injection passage 1E through which the refrigerant is supplied to the refrigerant suction chamber SP2. In other words, the scroll compressor 100 according to Embodiment 1 is configured such that the refrigerant is injected into the refrigerant suction chamber SP2. In such a configuration of the scroll compressor 100 according to Embodiment 1, an increase in pressure in the refrigerant compression chamber SP1 upon injection is reduced, as compared with the configuration of the related-art scroll compressor, or the configuration in which the refrigerant is injected into the refrigerant compression chamber SP1. Specifically, in the configuration of the related-art scroll compressor, liquid refrigerant tends to expand in the refrigerant compression chamber SP1, and a pressure in the refrigerant compression chamber SP1 tends to increase accordingly. In contrast, since the scroll compressor 100 according to Embodiment 1 is configured such that the refrigerant is injected into the refrigerant suction chamber SP2, liquid refrigerant expands in the refrigerant suction chamber SP2. In other words, this configuration reduces the possibility that the liquid refrigerant may expand in the refrigerant compression chamber SP1. Thus, an increase in pressure in the refrigerant compression chamber SP1 is reduced. Since an increase in pressure in the refrigerant compression chamber SP1 is reduced, motion of the orbiting scroll 2 is unlikely to be hindered. As described above, the motion of the orbiting scroll 2 is hardly hindered in the scroll compressor 100, leading to improved compressor efficiency of the scroll compressor 100.

In the configuration of the related-art scroll compressor, or the configuration in which the refrigerant is injected into the refrigerant compression chamber SP1, the refrigerant compressed in the refrigerant compression chamber SP1 escapes to an injection passage while the refrigerant is not injected into the chamber. The injection passage does not contribute to compression of the refrigerant. In other words, in the configuration of the related-art scroll compressor, the refrigerant compressed in the refrigerant compression chamber SP1 escapes to the injection passage while the refrigerant is not injected into the chamber, and the compressor efficiency of the related-art scroll compressor decreases accordingly. In contrast, as described above, the scroll compressor 100 according to Embodiment 1 is configured such that the refrigerant is injected into the refrigerant suction chamber SP2. Therefore, the scroll compressor 100 according to Embodiment 1 exhibits higher compressor efficiency as compared with the related-art scroll compressor.

The injection passage 1E includes the outlet passage sections 1E3 extending linearly. The refrigerant compression chamber SP1 is disposed on the extensions of the outlet passage sections 1E3. In this arrangement, when the refrigerant is injected into the refrigerant suction chamber SP2, the refrigerant supplied from the outlet passage sections 1E3 to the refrigerant suction chamber SP2 flows to a region where the refrigerant compression chamber SP1 is disposed. Consequently, the refrigerant supplied from the outlet passage sections 1E3 to the refrigerant suction chamber SP2 is immediately directed to the refrigerant compression chamber SP1. In other words, this reduces the possibility that the refrigerant supplied from the outlet passage sections 1E3 to the refrigerant suction chamber SP2 may flow toward the bottom sump 50C1 through the suction passage 3B and the refrigerating machine oil in the bottom sump 50C1 may thus be diluted with the refrigerant. As described above, the refrigerating machine oil in the bottom sump 50C1 is unlikely to be diluted with the refrigerant even when the refrigerant is injected into the refrigerant suction chamber SP2. Thus, it is unlikely that sliding parts in the compression mechanism Cm are insufficiently lubricated even when the refrigerant is injected into the refrigerant suction chamber SP2.

The refrigerant compression chamber SP1 is disposed on the extensions of the outlet passage sections 1E3. This arrangement allows the refrigerant flowing from the outlet passage sections 1E3 into the refrigerant suction chamber SP2 to be immediately directed to the refrigerant compression chamber SP1. In other words, this arrangement ensures that the refrigerant is supplied from the injection passage 1E to the refrigerant compression chamber SP1, leading to improved injection efficiency. Therefore, the amount of refrigerant to be injected can be reduced in the scroll compressor 100.

Since the amount of refrigerant to be injected can be reduced in the scroll compressor 100, a reduction in refrigerant flow rate through a refrigerant circuit in the refrigeration cycle apparatus 200 is reduced. This leads to improved operation efficiency of the refrigeration cycle apparatus 200.

Since the injection passage 1E is provided in the fixed scroll 1, outlet ports of the injection passage 1E, or the opening port Op1 and the opening port Op2, are accordingly close to the refrigerant compression chamber SP1. Such an arrangement keeps a flux of refrigerant that has flowed from the injection passage 1E into the refrigerant suction chamber SP2 from expanding while moving to the region where the refrigerant compression chamber SP1 is disposed. Therefore, the configuration of the scroll compressor 100 readily reduces the possibility that the refrigerant in the refrigerant suction chamber SP2 may flow toward the bottom sump 50C1 through the suction passage 3B and the possibility that the sliding parts of the compression mechanism Cm may be insufficiently lubricated.

Since the injection passage 1E is provided in the fixed scroll 1, the fixed scroll 1 is cooled by the refrigerant supplied from the injection pipe 23. This reduces thermal expansion of the fixed scroll 1. Consequently, the first spiral element 1A hardly contacts the second end plate 2B and the second spiral element 2A hardly contacts the first end plate 1B, thus retarding wear of the sliding parts of the compression mechanism Cm.

The injection passage 1E includes the outlet passage sections 1E3 extending linearly, and the refrigerant compression chamber SP1 is disposed on the extensions of the outlet passage sections 1E3, This arrangement allows the refrigerant supplied from the outlet passage sections 1E3 to the refrigerant suction chamber SP2 to be immediately directed to the refrigerant compression chamber SP1. In other words, this arrangement causes the refrigerant supplied from the outlet passage sections 1E3 to the refrigerant suction chamber SP2 to hardly contact the frame 3. The frame 3 is accordingly unlikely to be cooled by the refrigerant supplied from the outlet passage sections 1E3 to the refrigerant suction chamber SP2. This reduces thermal contraction of the frame 3. If the frame 3 thermally contracts, a face of the frame 3 on which the orbiting scroll 2 slides may be raised to a higher position. If the face of the frame 3 on which the orbiting scroll 2 slides is raised to a higher position, the orbiting scroll 2 will also be raised to a higher position, so that the first spiral element 1A is likely to contact the second end plate 2B and the second spiral element 2A is likely to contact the first end plate 1B, accelerating wear of the sliding parts of the compression mechanism Cm. However, since the frame 3 of the scroll compressor 100 is hardly cooled by the refrigerant supplied from the outlet passage sections 1E3 to the refrigerant suction chamber SP2, the face of the frame 3 on which the orbiting scroll 2 slides is hardly raised to a higher position, Consequently, wear of the sliding parts of the compression mechanism Cm is retarded.

The second end plate 2B slides relative to the tip of the first spiral element 1A. The tip of the second spiral element 2A also slides relative to the first end plate 1B. In other words, the tip of the first spiral element 1A, the second end plate 2B, the tip of the second spiral element 2A, and the first end plate 1B are the sliding parts of the compression mechanism Cm. The first spiral element 1A and the second spiral element 2A are arranged on the extensions of the outlet passage sections 1E3. In this arrangement, the injected refrigerant hardly flows between the tip of the first spiral element 1A and the second end plate 2B and between the tip of the second spiral element 2A and the first end plate 1B. Therefore, the arrangement in the scroll compressor 100 reduces the possibility that the injected refrigerant may remove the refrigerating machine oil between the tip of the first spiral element 1A and the second end plate 2B and the refrigerating machine oil between the tip of the second spiral element 2A and the first end plate 1B. Since the possibility that the refrigerating machine oil may be removed by the flowing refrigerant is reduced, this allows improved sealed engagement between the fixed scroll 1 and the orbiting scroll 2 and causes the orbiting scroll 2 to smoothly slide relative to the fixed scroll 1, resulting in improved compressor efficiency of the scroll compressor 100.

The second wall portion 2A6 of the second spiral element 2A is disposed on the extension of the first outlet passage section 1E3*a*, and the first wall portion 1A6 of the first spiral element 1A is disposed on the extension of the second outlet passage section 1E3*b*. This arrangement causes the refrigerant that has flowed from the first outlet passage section 1E3*a* into the refrigerant suction chamber SP2 to collide with the second wall portion 2A6, then flow along the second wall portion 2A6, and be supplied to the refrigerant compression chamber SP1, and causes the refrigerant that has flowed from the second outlet passage section 1E3*b* into the refrigerant suction chamber SP2 to collide with the first wall portion 1A6, then flow along the first wall portion 1A6, and be supplied to the refrigerant compression chamber SP1. Consequently, the refrigerant that has flowed into the refrigerant suction chamber SP2 from the first outlet passage section 1E3*a* and the second outlet passage section 1E3*b* is more immediately directed to the refrigerant compression chamber SP1. In other words, this arrangement further reduces the possibility that the refrigerant that has flowed into the refrigerant suction chamber SP2 from the first outlet passage section 1E3*a* and the second outlet passage section 1E3*b* may flow toward the bottom sump 50C1 through the suction passage 3B. Therefore, the arrangement in the scroll compressor 100 further reduces the possibility that the refrigerating machine oil in the bottom sump 50C1 may be diluted with the refrigerant and the possibility that the sliding parts of the scroll compressor 100 may be insufficiently lubricated.

The above-described arrangement causes the refrigerant that has flowed from the first outlet passage section 1E3*a* into the refrigerant suction chamber SP2 to hit the second wall portion 2A6, then flow along the second wall portion 2A6, and be supplied to the refrigerant compression chamber SP1, and causes the refrigerant that has flowed from the second outlet passage section 1E3*b* into the refrigerant suction chamber SP2 to collide with the first wall portion 1A6, then flow along the first wall portion 1A6, and be supplied to the refrigerant compression chamber SP1. In other words, the refrigerant suction chamber SP2 receives the refrigerant flowing through the first inlet in1 and the refrigerant flowing through the second inlet in2. Thus, the arrangement reduces uneven distribution of the refrigerant to spaces, namely, a space that is between the first inlet in1 and the discharge passage 1D in the refrigerant compression chamber SP1 and a space that is between the second inlet in2 and the discharge passage 1D in the refrigerant compression chamber SP1. This results in improved pressure balance in the refrigerant compression chamber SP1. The improved pressure balance in the refrigerant compression chamber SP1 keeps the orbiting scroll 2 from tilting relative to the frame 3, reducing or eliminating an increase in contact pressure between the orbiting scroll 2 and the frame 3. This retards wear of the orbiting scroll 2 and the frame 3. As described above, since the refrigerant flows into the refrigerant suction chamber SP2 through the first inlet int and the second inlet in2, wear of the orbiting scroll 2 and the frame 3 is retarded.

The injection passage 1E includes the inlet passage section 1E1 being connected to the injection pipe 23, the first branch passage section 1E2*a* having an upstream end being connected to the inlet passage section 1E1 and a downstream end being connected to the first outlet passage section 1E3*a*, and the second branch passage section 1E2*b* having an upstream end being connected to the inlet passage section 1E1 and a downstream end being connected to the second outlet passage section 1E3*b*. This arrangement allows the refrigerant supplied from the injection pipe 23 to the injection passage 1E to be distributed to the first outlet passage section 1E3*a* and the second outlet passage section 1E3*b*.

The first branch passage section 1E2*a* and the second branch passage section 1E2*b* are of equal length, and the first outlet passage section 1E3*a* and the second outlet passage section 1E3*b* are of equal length. This arrangement reduces the difference in pressure loss between a refrigerant passage including the inlet passage section 1E1, the first branch passage section 1E2*a*, and the first outlet passage section 1E3*a* and a refrigerant passage including the inlet passage section 1E1, the second branch passage section 1E2*b*, and the second outlet passage section 1E3*b*. This further reduces uneven distribution of the refrigerant to the space that is between the first inlet in1 and the discharge passage 1D in the refrigerant compression chamber SP1 and the space that is between the second inlet in2 and the discharge passage 1D in the refrigerant compression chamber SP1. This results in further improved pressure balance in the refrigerant compression chamber SP1, thus further keeping the orbiting scroll 2 from tilting relative to the frame 3 and further reducing or eliminating an increase in contact pressure between the orbiting scroll 2 and the frame 3. This further prevents wear of the orbiting scroll 2 and the frame 3. If the first branch passage section 1E2*a* and the second branch passage section 1E2*b* have different lengths or the first outlet passage section 1E3*a* and the second outlet passage section 1E3*b* have different lengths, the amount of refrigerant to be injected can be adjusted by making the sizes of the passage sections different from each other. In other words, the amounts of refrigerant supplied through the opening port Op1 and the opening port Op2 can be made even by changing the size of the first branch passage section 1E2*a*, the second branch passage section 1E2*b*, the first outlet passage section 1E3*a*, or the second outlet passage section 1E3*b*.

When the second spiral element 2A is located closest to the opening port Op1, the entirety of the opening port Op1 is located outside the second spiral element 2A. Consequently, the second spiral element 2A does not close the opening port Op1. This arrangement allows the refrigerant to be stably injected into the refrigerant compression chamber SP1 from the opening port Op1 through the refrigerant suction chamber SP2. In addition, this arrangement reduces clogging of the first outlet passage section 1E3*a* with, for example, foreign matter. Furthermore, the tip of the second spiral element 2A does not overlap the opening port Op1 in this arrangement. The arrangement reduces the possibility that the tip of the second spiral element 2A may be damaged, for example.

Embodiment 2

In Embodiment 2, the common components and parts to Embodiment 1 are designated by the same reference signs and a description of these components and parts is omitted. The following description will focus on the difference between Embodiment 1 and Embodiment 2.

<Configuration in Embodiment 2>

Figure 23:
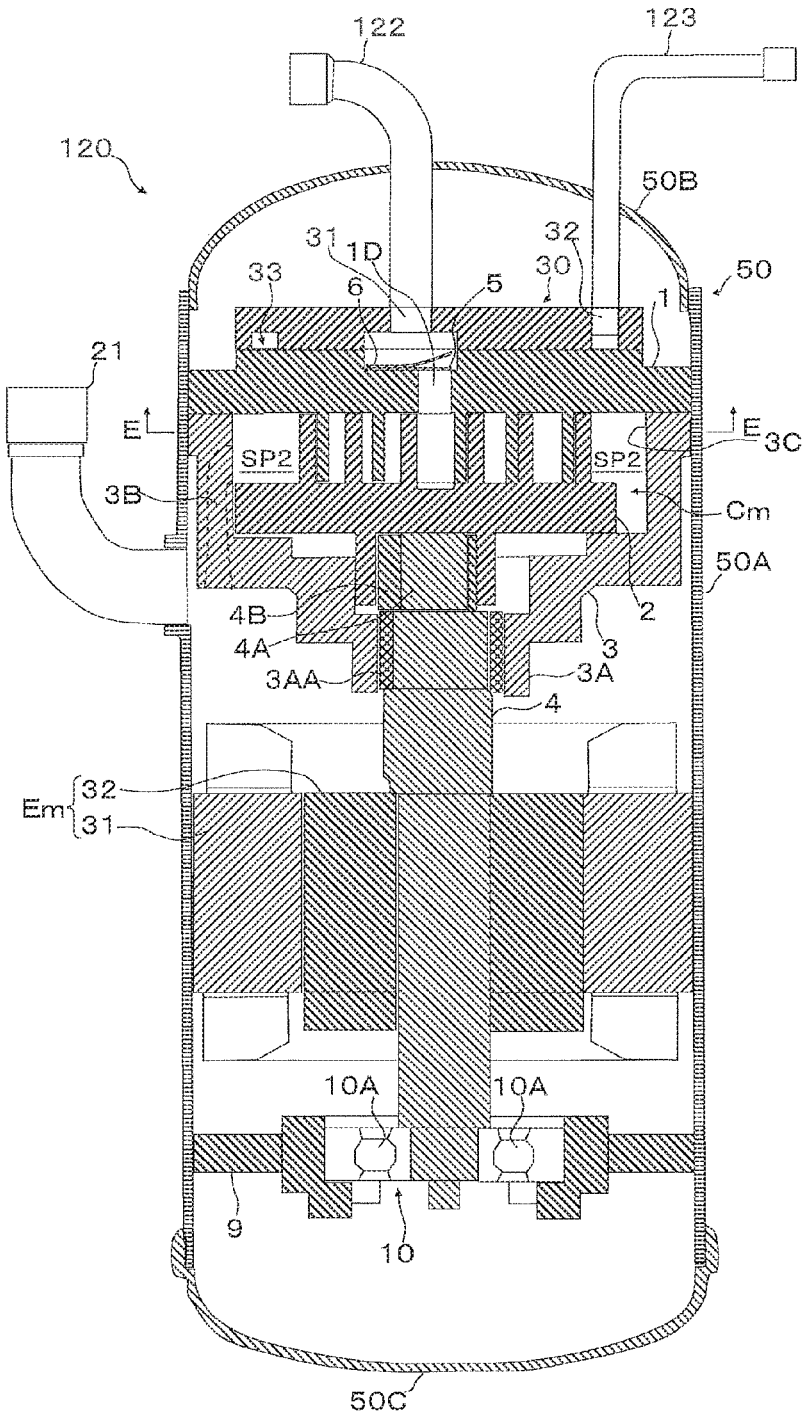
FIG. 23 is a sectional view of a scroll compressor 120 according to Embodiment 2.
Figure 24:
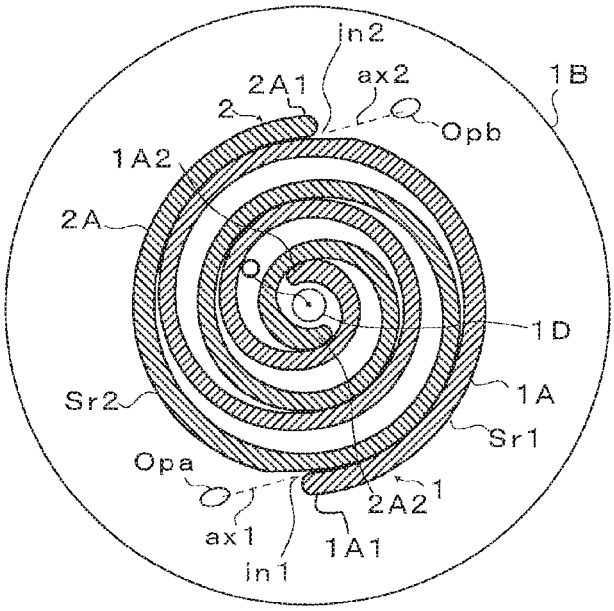
FIG. 24 is a diagram explaining an arrangement of an opening port Opa and an opening port Opb.
Figure 25:
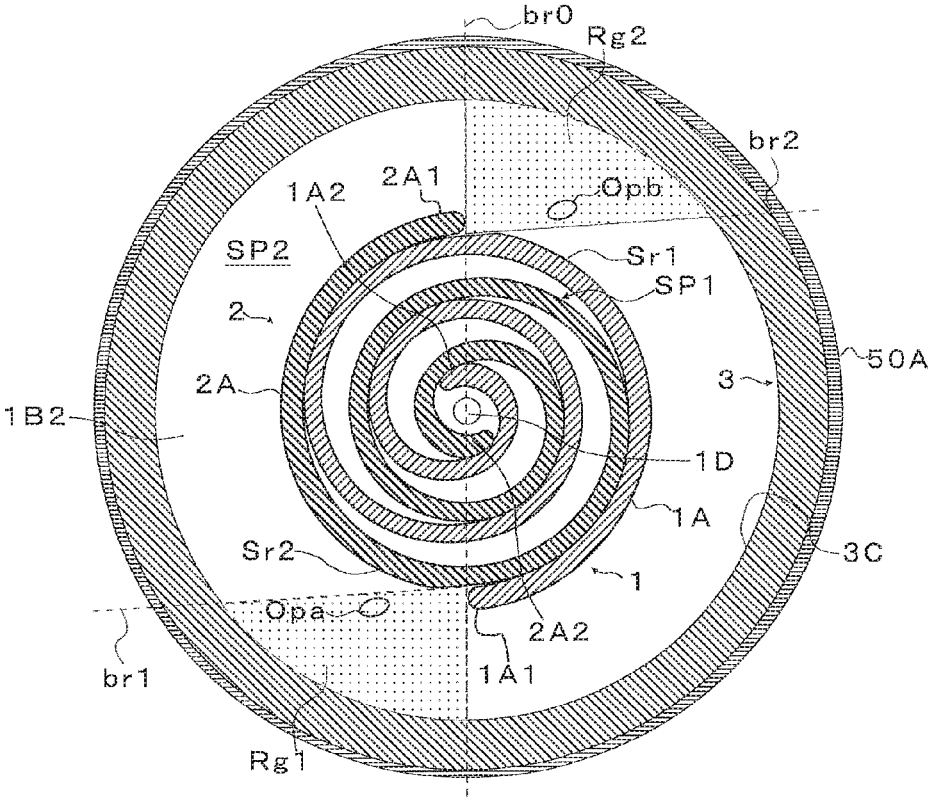
FIG. 25 is a cross-sectional plan view taken along line E-E in FIG. 23.
Figure 26:
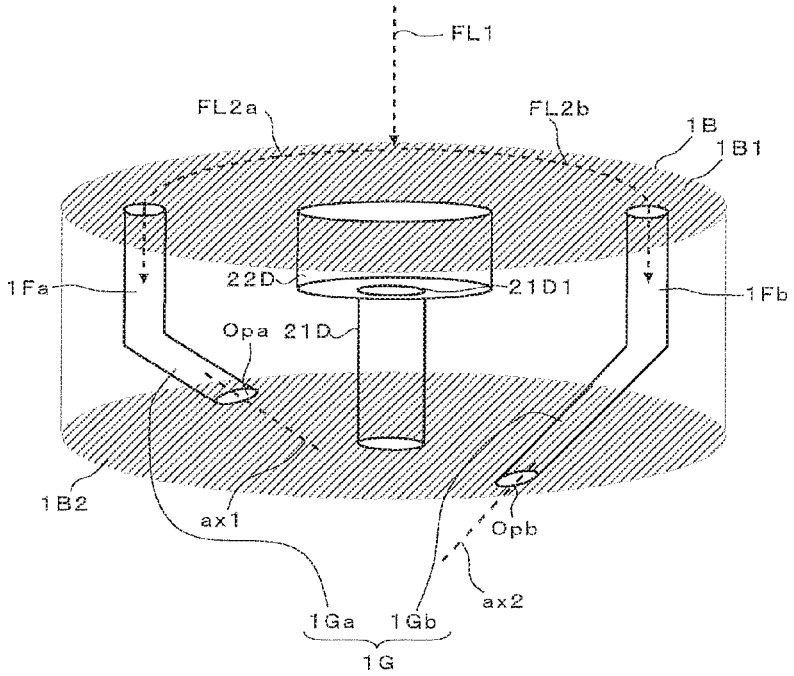
FIG. 26 is a perspective view illustrating an injection passage 1EE, a discharge passage 21D, and a recess 22D.
Figure 27:
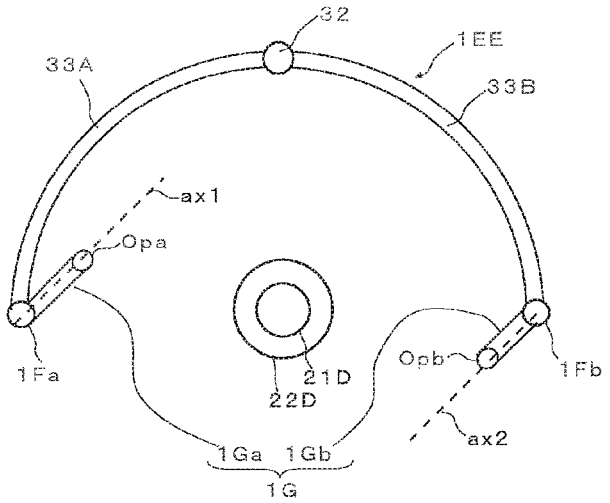
FIG. 27 is a top plan view of the injection passage 1EE, the discharge passage 1D, and the recess 22D.

FIG. 23 is a sectional view of a scroll compressor 120 according to Embodiment 2. FIG. 24 is a diagram explaining an arrangement of an opening port Opa and an opening port Opb. FIG. 25 is a cross-sectional plan view taken along line E-E in FIG. 23. FIG. 26 is a perspective view illustrating an injection passage 1EE, a discharge passage 21D, and a recess 22D. FIG. 27 is a top plan view illustrating the injection passage 1EE, the discharge passage 1D, and the recess 22D. As illustrated in FIG. 23, the scroll compressor 120 according to Embodiment 2 includes a plate 30 disposed on the fixed scroll 1. As illustrated in FIGS. 26 and 27, the plate 30 has an opening 31 in which a discharge pipe 122 is fitted. The plate 30 further has a passage 32 in which an injection pipe 123 is fitted, an arcuate passage 33A that branches off from the passage 32, and an arcuate passage 33B that branches off from the passage 32.

The injection passage 1EE of the fixed scroll 1 includes a passage section 1Fa extending vertically and a passage section 1Fb extending in parallel to the passage section 1Fa. The injection passage 1EE further includes outlet passage sections 1G through which refrigerant is supplied from the injection passage 1EE to the refrigerant suction chamber SP2. The outlet passage sections 1G include a first outlet passage section 1Ga being connected to the passage section 1Fa and a second outlet passage section 1Gb being connected to the passage section 1Fb. The opening port Opa and the opening port Opb open into the refrigerant suction chamber SP2. The first inlet in1 of the refrigerant compression chamber SP1 is disposed on an extension of the first outlet passage section 1Ga. The second inlet in2 of the refrigerant compression chamber SP1 is disposed on an extension of the second outlet passage section 1Gb. Specifically, as illustrated in FIGS. 24, 26, and 27, the first inlet int is disposed on the extension of the imaginary line ax1 extending through the first outlet passage section 1Ga, and the second inlet in2 is disposed on the extension of the imaginary line ax2 extending through the second outlet passage section 1Gb. In other words, the first outlet passage section 1Ga is directed to the first inlet in1 and the second outlet passage section 1Gb is directed to the second inlet in2. The fixed scroll 1 has the discharge passage 21D extending vertically, a discharge port 21D1, and the recess 22D in which the discharge valve 5 and the valve guard 6 are arranged.

<Operation in Embodiment 2>

Figure 28:
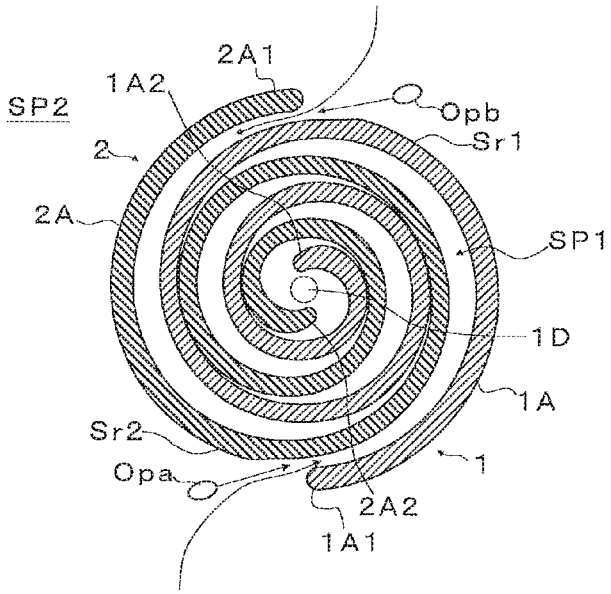
FIG. 28 schematically illustrates a state in which the first spiral element 1A is apart from the second outer end 2A1 of the second spiral element 2A.

FIG. 28 schematically illustrates a state in which the second outer end 2A1 of the second spiral element 2A is apart from the first spiral element 1A. An operation in Embodiment 2 will now be described with reference to FIG. 28 and FIGS. 23, 26, and 27 described above. Referring to FIGS. 23, 26, and 27, refrigerant FL1 passes through the injection pipe 123 and the passage 32 and then divides into two streams, namely, refrigerant FL2*a* flowing through the passage 33A and refrigerant FL2*b* flowing through the passage 33B. The refrigerant FL2*a* flowing through the passage 33A flows into the refrigerant suction chamber SP2 through the first outlet passage section 1Ga. The refrigerant FL2*b* flowing through the passage 33B flows into the refrigerant suction chamber SP2 through the second outlet passage section 1Gb.

In the state of FIG. 28, the first inlet in1 and the second inlet in2 are open. The refrigerant for injection is supplied to the refrigerant suction chamber SP2 through the opening port Opa of the first outlet passage section 1Ga and the opening port Opb of the second outlet passage section 1Gb. In addition, the refrigerant that has flowed from the lower space SPb through the suction passage 3B described with reference to FIG. 2 is supplied to the refrigerant suction chamber SP2. In the state of FIG. 28, the refrigerant supplied to the refrigerant suction chamber SP2 through the opening port Opa flows to the first inlet in1 and enters the first inlet in1. The refrigerant supplied to the refrigerant suction chamber SP2 through the opening port Opb flows to the second inlet in2 and enters the second inlet in2.

<Advantageous Effects of Embodiment 2>

The scroll compressor 120 according to Embodiment 2 has the same advantageous effects as those of the scroll compressor 100 according to Embodiment 1. Specifically, the first inlet in1 of the refrigerant compression chamber SP1 is disposed on the extension of the first outlet passage section 1Ga, and the second inlet in2 of the refrigerant compression chamber SP1 is disposed on the extension of the second outlet passage section 1Gb. In other words, the first outlet passage section 1Ga is directed to the first inlet in1 and the second outlet passage section 1Gb is directed to the second inlet in2. Such an arrangement causes the refrigerant supplied from the first outlet passage section 1Ga to the refrigerant suction chamber SP2 to flow to the first inlet in1, and causes the refrigerant supplied from the second outlet passage section 1Gb to the refrigerant suction chamber SP2 to flow to the second inlet in2. Consequently, the refrigerant that has flowed into the refrigerant suction chamber SP2 from the first outlet passage section 1Ga and the second outlet passage section 1Gb is more immediately directed to the refrigerant compression chamber SP1. In other words, this arrangement further reduces the possibility that the refrigerant that has flowed into the refrigerant suction chamber SP2 from the first outlet passage section 1Ga and the second outlet passage section 1Gb may flow toward the bottom sump 50C1 through the suction passage 3B. Thus, the scroll compressor 120 further reduces the possibility that the refrigerating machine oil in the bottom sump 50C1 may be diluted with the refrigerant and the possibility that the sliding parts of the scroll compressor 120 may be insufficiently lubricated.

REFERENCE SIGNS LIST

1 fixed scroll 1A first spiral element 1A1 first outer end 1A2 first inner end 1A3 first groove 1A4 spiral face 1A5 spiral face 1A6 first wall portion 1Aa upper end 1Ab lower end 1B first end plate 1B1 upper face 1B2 lower face 1B3 circumferential face 1C preventing part 1D discharge passage 1D1 discharge port 1E injection passage 1E1 inlet passage section 1E2*a* first branch passage section 1E2*b* second branch passage section 1E3 outlet passage section 1E3*a* first outlet passage section 1E3*b* second outlet passage section 1EE injection passage 1Fa passage section 1Fb passage section 1G outlet passage section 1Ga first outlet passage section 1Gb second outlet passage section 2 orbiting scroll 2A second spiral element 2A1 second outer end 2A2 second inner end 2A3 second groove 2A4 spiral face 2A5 spiral face 2A6 second wall portion 2Aa upper end 2Ab lower end 2B second end plate 2B1 upper face 2B2 lower face 2C boss 3 frame 3A main bearing 3AA sleeve 3B suction passage 3C inner circumferential face 4 shaft 4A eccentric portion 4B slider 5 discharge valve 6 valve guard 7 sound-absorbing muffler 8 fastener 9 sub-frame 10 sub-bearing 11 discharge valve 21 suction pipe 21D discharge passage 21D1 discharge port 22 discharge pipe 22D recess 23 injection pipe 30 plate 31 opening 32 passage 33A passage 33B passage 50 hermetic container 50A body 50B container upper portion 50C container lower portion 50C1 bottom sump 100 scroll compressor 101 condenser 101A fan 102 expansion device 103 evaporator 103A fan 104 heat exchanger 105 expansion device 120 scroll compressor 122 discharge pipe 123 injection pipe 200 refrigeration cycle apparatus Cm compression mechanism Cnt controller E31 stator E32 rotor Em drive mechanism L1 imaginary line Op1 opening port Op2 opening port Opa opening port Opb opening port P1 imaginary line Rg1 region Rg2 region SP1 refrigerant compression chamber SP2 refrigerant suction chamber SPa upper space SPb lower space Sr1 first wall surface Sr2 second wall surface in1 first inlet in2 second inlet

The invention claimed is:

1. A scroll compressor, comprising:

a hermetic container;

a compression mechanism disposed in the hermetic container, the compression mechanism having a refrigerant compression chamber and a refrigerant suction chamber disposed upstream of the refrigerant compression chamber in a direction in which refrigerant flows; and an injection pipe fitted in the hermetic container, the compression mechanism including a fixed scroll including a first end plate having a discharge passage, into which the refrigerant flows out of the refrigerant compression chamber, and a first spiral element disposed on the first end plate, and an orbiting scroll including a second end plate disposed at a distance from the first end plate and a second spiral element disposed on the second end plate, the second spiral element defining the refrigerant compression chamber between the first spiral element, the first end plate having an injection passage through which the refrigerant is supplied to the refrigerant suction chamber, the injection passage including an outlet passage section that opens into the refrigerant suction chamber and extends linearly, the refrigerant compression chamber being disposed on an extension of the outlet passage section, the outlet passage section including a first outlet passage section that opens into the refrigerant suction chamber and extends linearly and a second outlet passage section that opens into the refrigerant suction chamber and extends linearly, the injection passage including an inlet passage section being connected to the injection pipe, a first branch passage section having an upstream end being connected to the inlet passage section and a downstream end being connected to the first outlet passage section, and a second branch passage section having an upstream end being connected to the inlet passage section and a downstream end being connected to the second outlet passage section, wherein the upstream end of the first branch passage section and the upstream end of the second branch passage section connect to a downstream end of the inlet passage section, wherein the first branch passage section and the second branch passage section are of equal length, and wherein the first outlet passage section and the second outlet passage section are of equal length.

2. The scroll compressor of claim 1, wherein the first spiral element is disposed on the extension of the second outlet passage section, or the second spiral element is disposed on the extension of the first outlet passage section.

3. The scroll compressor of claim 1, wherein the first end plate has a lower face facing the refrigerant suction chamber, wherein the lower face has an opening port being connected to the first outlet passage section, and wherein the opening port as a whole is located outside the second spiral element when the second spiral element is located closest to the opening port.

4. The scroll compressor of claim 1, wherein the first spiral element includes a first wall portion separating the refrigerant suction chamber and the refrigerant compression chamber, wherein the second spiral element includes a second wall portion separating the refrigerant suction chamber and the refrigerant compression chamber, wherein the second wall portion is disposed on an extension of the first outlet passage section, and wherein the first wall portion is disposed on an extension of the second outlet passage section.

5. The scroll compressor of claim 4, wherein the refrigerant compression chamber has a first inlet through which the refrigerant in the refrigerant suction chamber flows into the refrigerant compression chamber and a second inlet through which the refrigerant in the refrigerant suction chamber flows into the refrigerant compression chamber, wherein the first wall portion has a first outer end defining the first inlet between the second spiral element, wherein the second wall portion has a second outer end defining the second inlet between the first spiral element, wherein the first outlet passage section is directed to the first inlet, and wherein the second outlet passage section is directed to the second inlet.

6. The scroll compressor of claim 1, wherein the refrigerant compression chamber has a first inlet through which the refrigerant in the refrigerant suction chamber flows into the refrigerant compression chamber and a second inlet through which the refrigerant in the refrigerant suction chamber flows into the refrigerant compression chamber, wherein the first spiral element includes a first wall portion separating the refrigerant suction chamber and the refrigerant compression chamber, wherein the first wall portion has a first outer end defining the first inlet between the second spiral element, wherein the second spiral element includes a second wall portion separating the refrigerant suction chamber and the refrigerant compression chamber, wherein the second wall portion has a second outer end defining the second inlet between the first spiral element, wherein the first outlet passage section is directed to the first inlet, and wherein the second outlet passage section is directed to the second inlet.

7. The scroll compressor of claim 1, wherein the refrigerant compression chamber has a first inlet through which the refrigerant in the refrigerant suction chamber flows into the refrigerant compression chamber and a second inlet through which the refrigerant in the refrigerant suction chamber flows into the refrigerant compression chamber, wherein the first spiral element includes a first wall portion separating the refrigerant suction chamber and the refrigerant compression chamber, wherein the first wall portion has a first outer end defining the first inlet between the second spiral element, wherein the second spiral element includes a second wall portion separating the refrigerant suction chamber and the refrigerant compression chamber, wherein the second wall portion has a second outer end defining the second inlet between the first spiral element, wherein the first inlet of the refrigerant compression chamber is disposed on an extension of the first outlet passage section, and wherein the second inlet of the refrigerant compression chamber is disposed on an extension of the second outlet passage section.

* * * * *